US006126168A

United States Patent [19]

Nesis

[11] Patent Number: 6,126,168

[45] Date of Patent: Oct. 3, 2000

[54] MONEY COUNTING GAME AND APPARATUS

[76] Inventor: Dov Nesis, 4 Efter Street, Apt 12, Tel-Aviv 69362, Israel

[21] Appl. No.: 09/249,947

[22] Filed: Feb. 12, 1999

[51] Int. Cl.[7] ..... A63F 9/00

[52] U.S. Cl. ..... 273/445; 273/459

[58] Field of Search ..... 273/445, 446, 273/459, 460, 440, 447; 434/107, 110

[56] References Cited

U.S. PATENT DOCUMENTS 4,959,017 9/1990 Thompson et al. ..... 273/460 X 5,429,373 7/1995 Chelko et al. ..... 273/440

5,794,944 8/1998 Roberts ..... 273/447

*Primary Examiner*—Raleigh W. Chiu

*Attorney, Agent, or Firm*—Robert W. J. Usher

[57] ABSTRACT

A money counting game or contest in which one or more players attempt to manually count large amounts of currency within a predetermined, relatively long period of time to win a prize. Audio and video monitoring apparatus are provided to record the players.

4 Claims, 1 Drawing Sheet

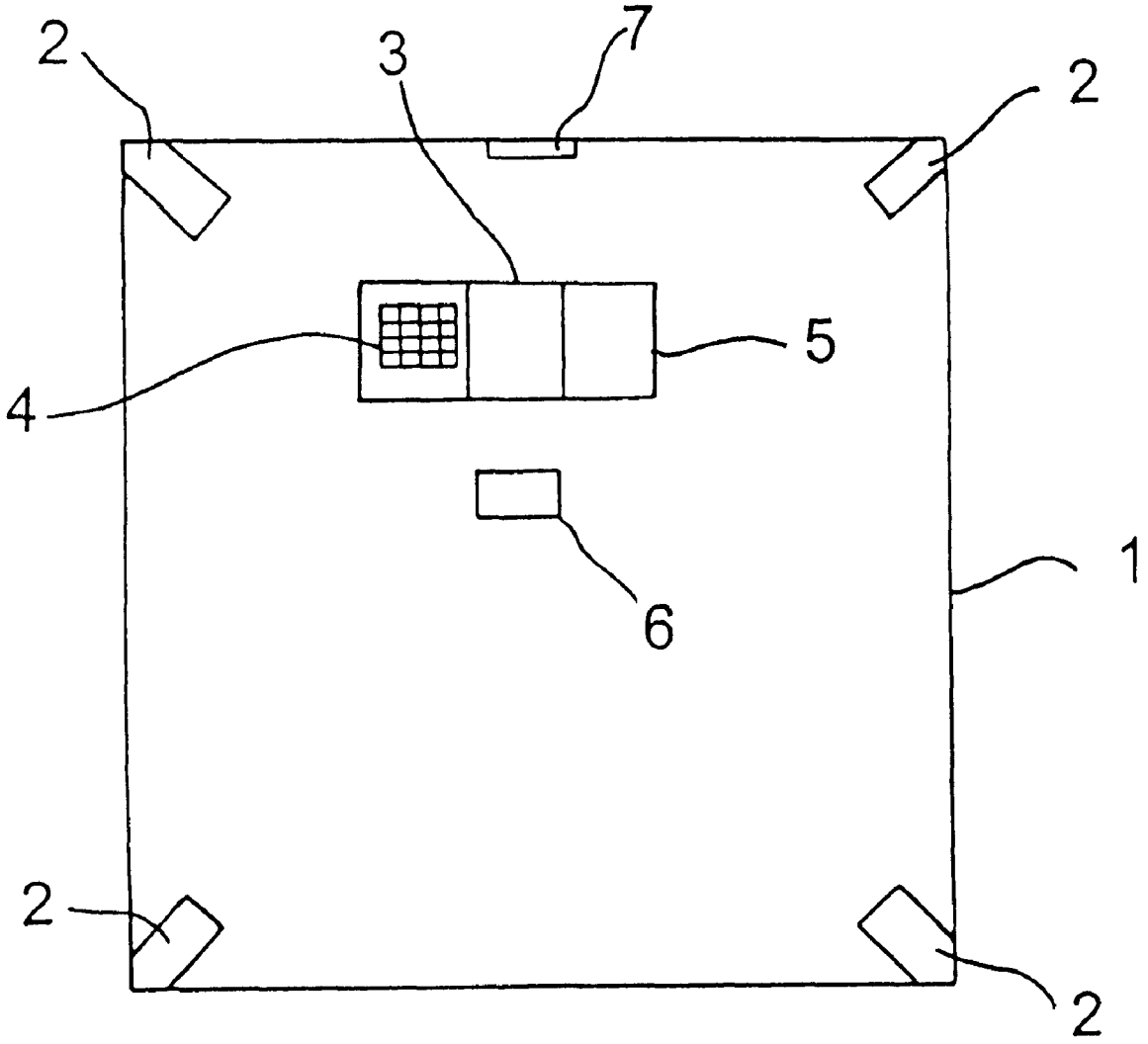
2
3
7
2
5
4
6
1
2
2

MONEY COUNTING GAME AND APPARATUS

FIELD OF THE INVENTION

The invention relates to a money counting game or contest in which one or more players attempt to manually count large amounts of currency within a predetermined period of time to win a prize.

BACKGROUND OF THE INVENTION

Games or contests in which one or more persons using various manual techniques attempted to transfer fairly large amounts of coins or notes between two locations in a studio in a predetermined, short period of time to win a prize, often equal to the amount of money actually moved, were widely broadcast by television during the middle part of the century.

All those games and proposals were of relatively short duration.

SUMMARY OF THE INVENTION

According to the present invention, in order to win a prize, one or more players or contestants attempts to accurately count unaided a very large amount of currency within a predetermined, relatively long time period.

More specifically, a method of playing a game comprising the steps of:

providing a supply of a predetermined, large amount of identical currency units of identical value, the supply requiring many hours to count manually, one unit at a time;

providing a designated area for accommodating a person counting the money;

a person attempting to manually count the currency cumulatively, one unit at a time within a predetermined time period corresponding to said many hours, less any predetermined break time periods, while stating audibly the cumulative value of the units counted, for each unit counted;

providing audio and video monitoring apparatus and recording each of the stated values;

at least periodically, measuring actual cumulative values of money counted and comparing the actual cumulative values with the stated cumulative values;

awarding a prize to a person who both completes counting the predetermined amount within the predetermined time period, less the predetermined break time periods, and accurately states cumulative values which correspond to one of each actual cumulative value counted and one of each actual cumulative value counted less a preselected number of permitted errors.

In another version of the game, several contestants attempt to count large amounts of money simultaneously and a prize is awarded to the first to finish an accurate count within the predetermined time.

It will be understood that the term currency includes real or fake, (look alike), notes or coins or vouchers, chips etc.

BRIEF DESCRIPTION OF THE DRAWING

The FIGURE is a schematic plan view of an area designated for an individual for counting the money.

DESCRIPTION OF PARTICULAR EMBODIMENTS

As shown in the drawing, an enclosure 1 for accommodating a player attempting to count the currency has video/surveillance type cameras for sound and vision mounted in all four corners for surveillance of all portions of the enclosure. A table 3 has a supply of currency 4 (e.g $100,000 in $1 bills) the total amount/range of amount of which is known and prestated stacked at one end and a receptacle 5 for counted currency at the other end. A seat 6 for the counter is provided on one side of the table between the two ends and a wall clock is provided on an opposite wall indicating the elapsed time or time remaining to completely count all the bills in the supply 4. The player picks up currency from the supply and, counts the bills one by one into the receptacle 5, which is periodically replaced by an empty receptacle and the amount stated by the player at the time of emptying recorded and checked by a note counting machine in the player's presence at the end of the game, or during the game, for an audience. A check is also made to verify that successive utterances of values are in fact sequential values, i.e. that the count is proceeding one by one.

A speech recognition system is also part of the (audio) monitoring system, being particularly useful for verifying that the cumulative count for each single card counted is correct.

If the player does not complete the count within the time period or makes more than a preselected number of errors in the progressive count, he forfeits a prize, which can be the entire amount of the supply.

Several players, in respective enclosure, can participate simultaneously and their efforts broadcast/simulcast.

I claim:

1. A method of playing a game comprising the steps of:

providing a supply of a predetermined, large amount of identical currency units of identical value, the supply requiring many hours to count manually, one unit at a time;

providing a designated area for accommodating a person counting the money;

a person attempting to manually count the currency cumulatively, one unit at a time within a predetermined time period corresponding to said many hours, less any predetermined break time periods, while stating audibly the cumulative value of the units counted, for each unit counted;

providing audio and video monitoring apparatus and recording each of the stated values;

at least periodically, measuring actual cumulative values of money counted and comparing the actual cumulative values with the stated cumulative values;

awarding a prize to a person who both completes counting the predetermined amount within the predetermined time period, less the predetermined break time periods, and accurately states cumulative values which correspond to one of each actual cumulative value counted and one of each actual cumulative value counted less a preselected number of permitted errors.

2. A method of playing a game according to claim 1 including the step of checking that each successively stated value is sequential.

3. Apparatus for playing a game in which a person attempts to count, cumulatively, a predetermined, large amount of identical currency units of identical value, one unit at a time within a predetermined time period, while stating audibly the cumulative value of the units counted, for each unit counted, comprising:

a supply of a predetermined, large amount of identical currency units of identical value which would require many hours for a person to count manually, one unit at a time;

timing means;

a designated area for accommodating a person counting the money;

audio and video monitoring apparatus for recording each of the stated values; and, means for periodically, measuring actual cumulative values of money counted and comparing actual cumulative values with stated cumulative values;

rewarding a person who both completes counting the predetermined amount within the predetermined time period, less the predetermined break time periods, and accurately states cumulative values which correspond to one of each actual cumulative value counted and one of each actual cumulative value counted less a preselected number of permitted errors.

4. Apparatus according to claim 3 including means for recognizing speech of a person counting.

* * * * *